US005294171A

United States Patent [19]

Horng

[11] Patent Number: 5,294,171

[45] Date of Patent: Mar. 15, 1994

[54] SAFE MULTI-FUNCTIONAL FOLDABLE LEISURE CHAIR

[76] Inventor: Min-Liang Horng, No. 11 Minsheng East Road, Section 2, Taipei City, Taiwan

[21] Appl. No.: 90,239

[22] Filed: Jul. 13, 1993

[51] Int. Cl.[5] ..... A47C 4/00

[52] U.S. Cl. ..... 297/38; 297/35; 297/399; 297/220

[58] Field of Search ..... 297/38, 16, 31, 35, 297/39, 40, 46, 220, 223, 229, 118, 376, 381, 393, 399

[56] References Cited

U.S. PATENT DOCUMENTS

| | | | |
|---|---|---|---|
| 2,451,652 | 10/1948 | Bazelon | 297/399 X |
| 2,887,150 | 5/1959 | Thomas | 297/35 X |
| 4,725,094 | 2/1988 | Greer | 297/220 X |
| 4,898,421 | 2/1990 | Brunn | 297/35 X |

FOREIGN PATENT DOCUMENTS

| | | | |
|---|---|---|---|
| 547406 | 5/1956 | Belgium | 297/39 |

*Primary Examiner*—Laurie K. Cranmer
*Attorney, Agent, or Firm*—Bacon & Thomas

[57] ABSTRACT

A safe multi-functional foldable leisure chair composed of a chair frame body, a chair pad disposed thereon, and a waters guiding pad, wherein the water-guiding pad is optionally detachably disposed on the chair frame body, permitting the leisure chair to alternatively serve as a shampooing chair; the chair frame body being composed of a plurality of frame members which are connected by pivot means and formed with stopper blocks, whereby when not used, the chair frame body can be folded into a flat and small body for easy storage, and when folding the chair frame body, the stopper blocks form an obstacle at a bending corner to keep a space between the frame members for protecting the hands of the user from being clamped and injured.

5 Claims, 6 Drawing Sheets

SAFE MULTI-FUNCTIONAL FOLDABLE LEISURE CHAIR

BACKGROUND OF THE INVENTION

The present invention relates to a safe multi-functional foldable leisure chair comprising a chair frame body, a chair pad disposed thereon and a water-guiding pad, wherein the water-guided pad is optionally detachably disposed on the chair frame body, permitting the leisure chair to alternatively serve as a shampooing chair. The chair frame body is composed of a plurality of frame members which are connected by pivot means and formed with stopper blocks, whereby the chair frame body can be folded into a flat and small body for easy storage, and when folding the chair frame body, the hand of the user is prevented from being clamped and injured.

Conventional leisure chair is generally composed of a chair frame body, a front and a rear legs which are pivoted thereto and a chair pad laid over the chair frame body. Such structure can only serve as a leisure chair while lacking other functions. When not used, the front and rear legs can be pivoted toward each other into a folded state for storage. However, the conventional leisure chair cannot be folded into a desirably small body for easy storage. Moreover, the conventional leisure chair is not designed with any safety mechanism and therefore, the hands of the user are likely to be clamped and injured by the chair frame body when folding the same.

SUMMARY OF THE INVENTION

It is therefore a primary object of the present invention to provide a safe multi-functional foldable leisure chair composed of a chair frame body, a chair pad, and a water-guiding pad, wherein the water-guiding pad can be optionally detachably associated with an upper portion of the chair frame body, making the leisure chair alternatively serve as a shampooing chair.

It is a further object of the present invention to provide the above leisure chair in which the chair frame body is composed of a plurality of frame members which are connected by multiple pivot mechanisms, permitting the chair frame body to be folded into a flat and small body for easy storage.

It is still a further object of the present invention to provide the above leisure chair which is designed with stopper blocks at bending corners of the chair frame body, whereby when the chair frame body is folded, the stopper blocks keep a space at the bending corners, preventing the hand of the user from being clamped and injured so as to ensure the safety of the user.

BRIEF DESCRIPTION OF THE DRAWINGS

The present invention can be best understood through the following detailed description of the preferred embodiment and the accompanying drawings, wherein.

DETAILED DESCRIPTION OF THE PREFERRED EMBODIMENTS

Figure 1:
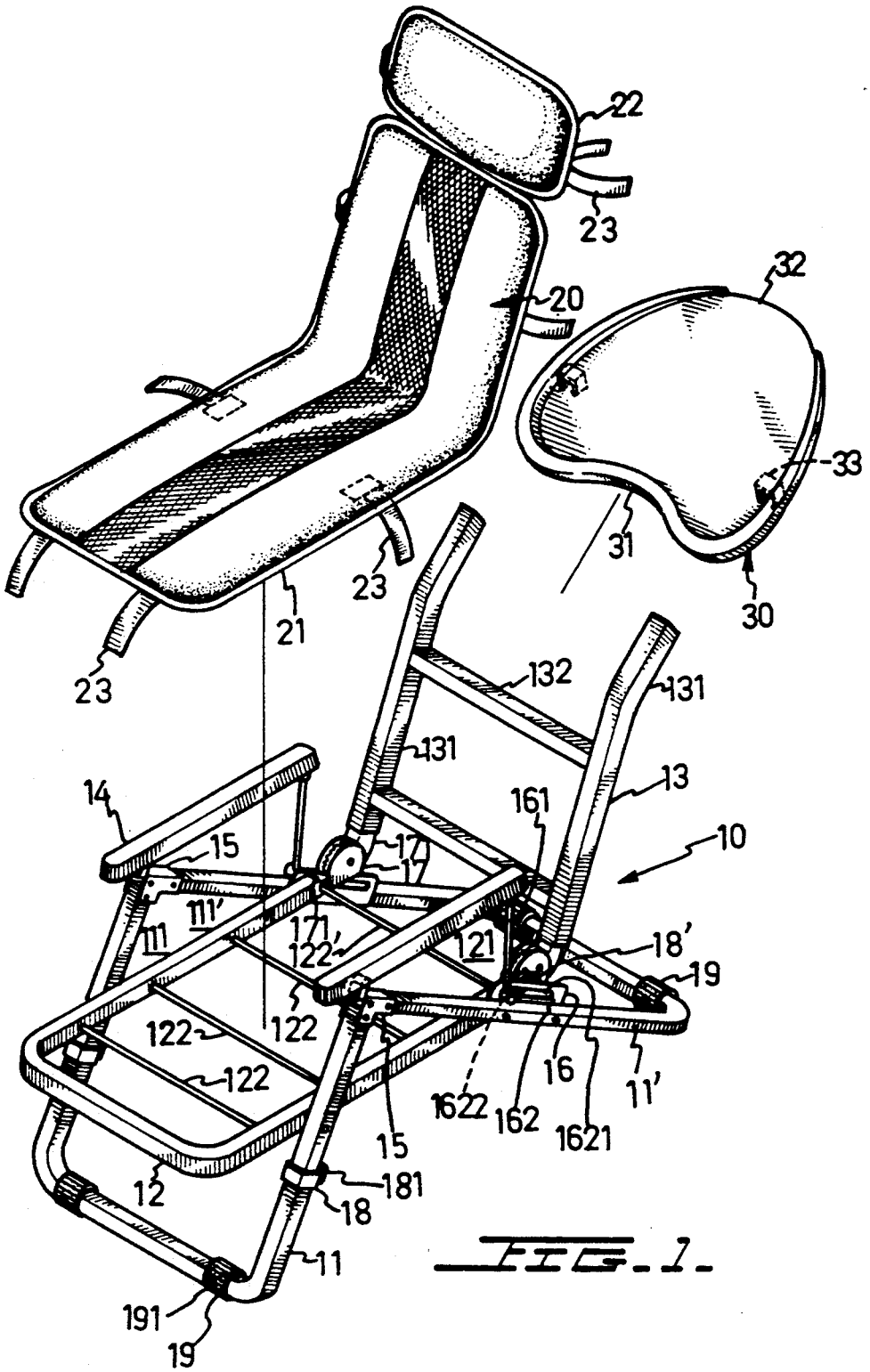
FIG. 1 is a perspective exploded view of the present invention.
Figure 2:
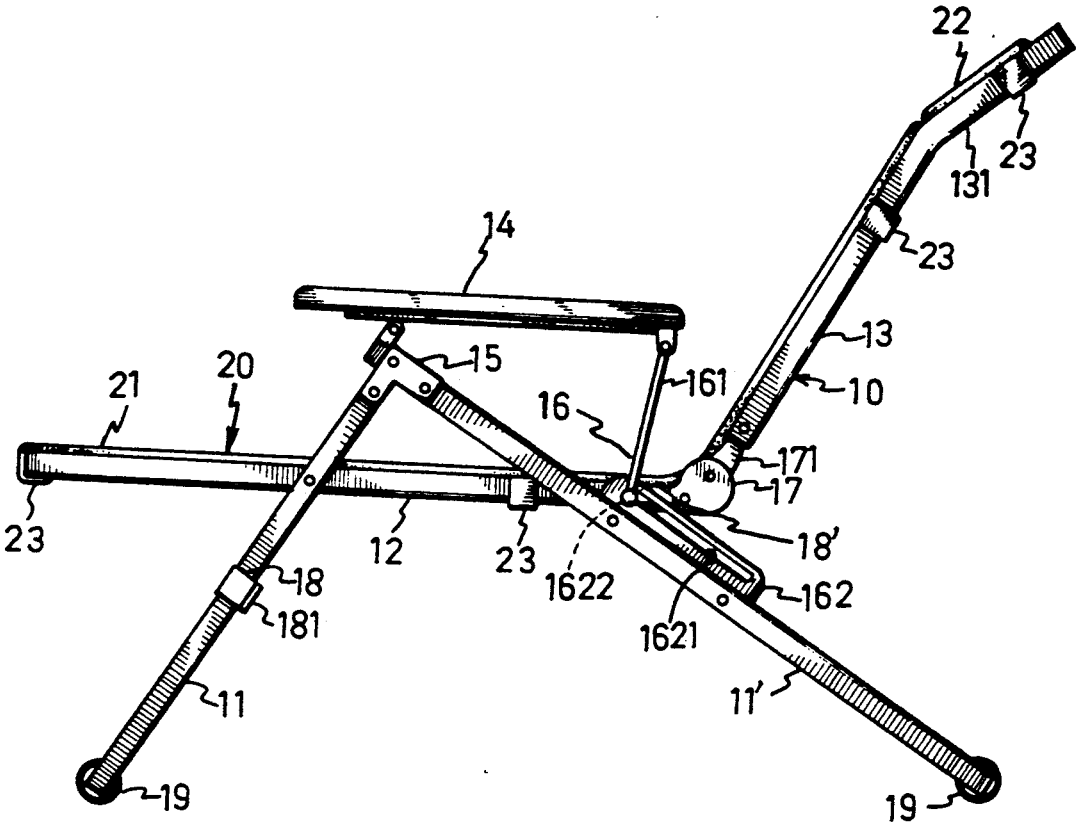
FIG. 2 is a plane side view thereof.

Please refer to FIG. 1. The multi-functional leisure chair of the present invention is mainly composed of a chair frame body 10, a chair pad 20 disposed on the chair frame body 10, and a water-guiding pad 30 optionally detachably disposed on the chair frame body 10. When the water-guiding pad 30 is disposed on the chair frame body 10, the leisure chair can alternatively serve as a shampooing chair. The chair frame body 10 is composed of a plurality of frame members which are pivotly connected with one another, permitting the frame body 10 to be folded into a flat and small body for easy storage. The frame body 10 is further formed with stopper blocks which protect the hand of a user from being clamped and injured by the frame body 10 when folding the same so that the safety of the user can be ensured.

Figure 3:
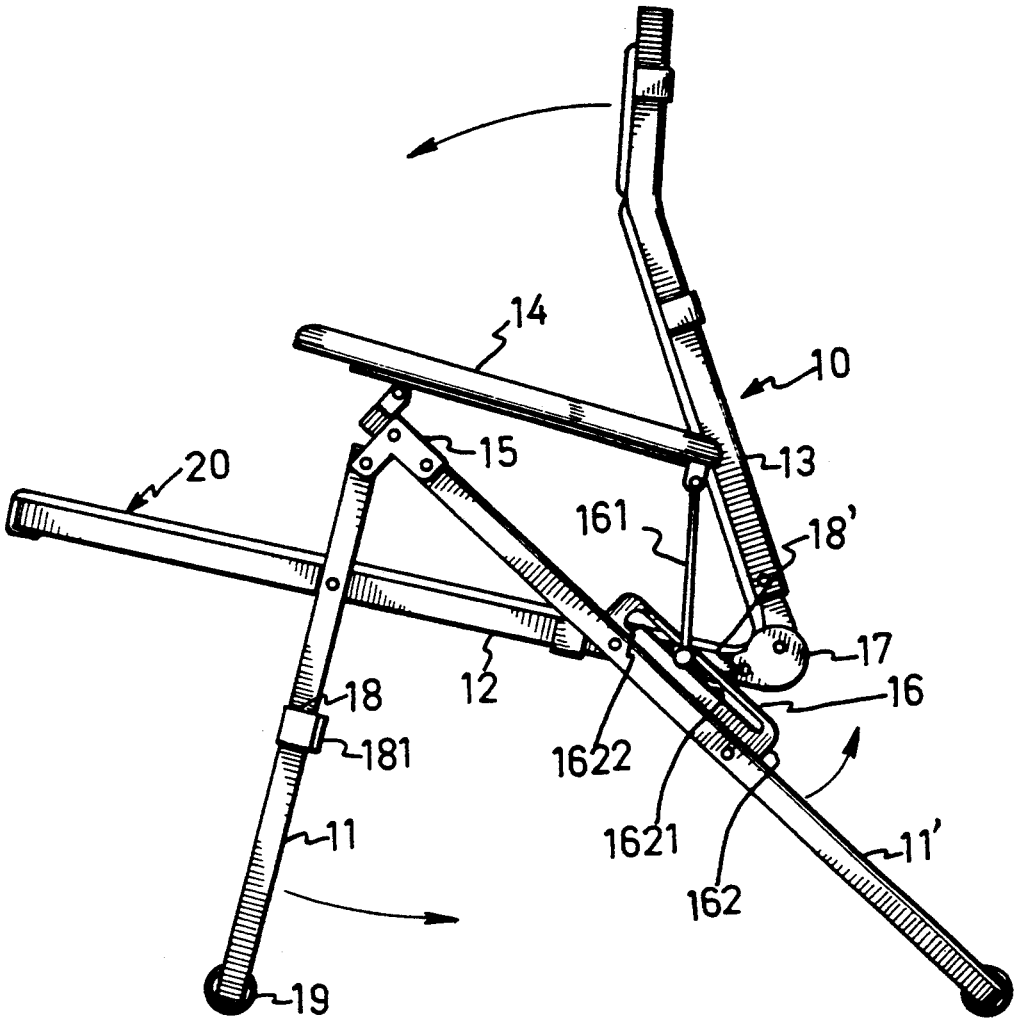
FIG. 3 is a plane side view according to FIG. 2, showing that the present invention is half folded.
Figure 4:
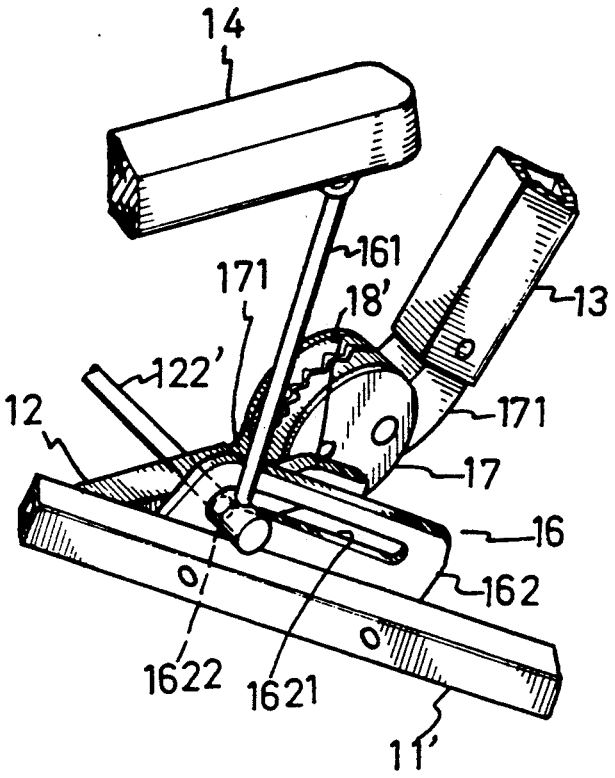
FIG. 4 shows the angle-adjusting means, fixing set, and stopper blocks of the present invention.
Figure 5:
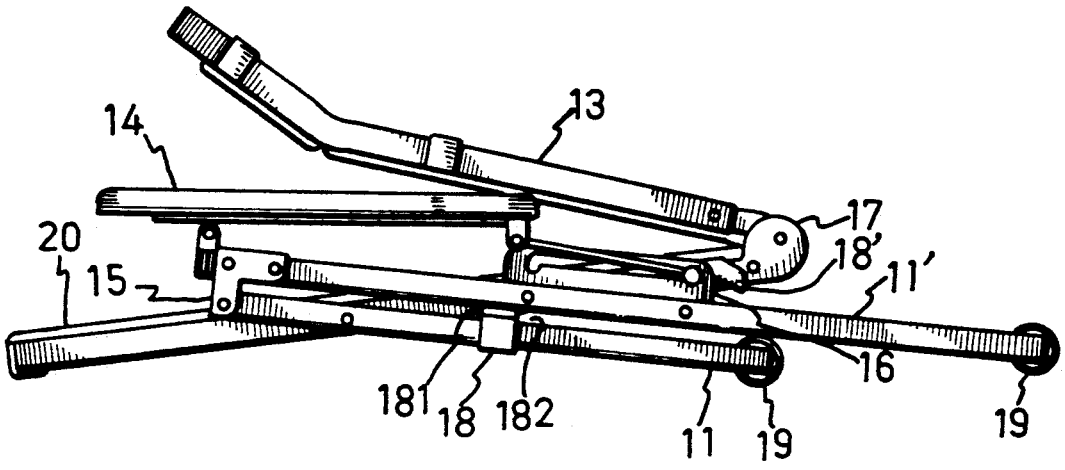
FIG. 5 is a plane side view according to FIG. 2, showing that the present invention is totally folded.

As shown in FIGS. 1 through 6, the chair frame body 10 is composed of:

a U-shaped front support leg 11 and a U-shaped rear support leg 11', the front and rear support legs 11, 11' respectively having upper open sides 111, 111' and lower close sides, in which the upper open sides 111, 111' are connected with each other while the lower close sides are extended forward and rearward in a stretched state;

a horizontally disposed U-shaped seat frame 12 having an open side 121 which faces rearward, a plurality of first beam members 122 being disposed between two arms of the seat frame 12, and a second beam member 122' being disposed across the open side 121 of the seat frame 12, two ends of the second beam member 122' laterally projecting from the open side 121 of the seat frame 12;

an H-shaped back frame 13 having two lateral column members 131 and a plurality of beam members 132 connected between the column members 131, upper ends of the column members 131 being slightly bent rearward and lower ends thereof being connected with the open side 121 of the seat frame 12;

two rail members 14 disposed on the connected open sides of the front and rear support legs 11, 11';

two pivot seats 15 pivotally connected with front ends of the rail members 14 and the open sides of the front and rear support legs 11, 11', permitting the rail members 14 and the front and rear support legs 11, 11' to be pivoted toward one another through a certain angle;

two fixing sets 16 each of which has a T-shaped fixing rod 161 and a fixing plate 162, wherein the fixing plate 162 is secured on an inner middle section of the rear support leg 11', and formed with an L-shaped slot 1621 having a downward facing hook portion 1622, lower end of the T-shaped fixing rod 161 extending downward to connect with the end of the second beam member 122' which goes through the L-shaped slot 1621, upper end of the fixing rod 161 being pivotally connected under a rear end of the rail member 14, whereby when the end of the second beam member 122' is slided within the L-shaped slot 1621, the chair frame body 10 can be folded into a small body;

two angle-adjusting means 17 having inner movable engaging teeth and front and rear projections 171 which are connected between a bottom side of the back frame 13 and the open side of the seat frame 12, whereby the angle contained by the front and rear projections 171 can be adjusted to change the bending angle contained by the back frame 13 and the seat frame 12;

two front stopper blocks 18 and two rear stopper blocks 18', wherein the front stopper blocks 18 are rectangular blocks and disposed on a middle section of the front support leg 11, the front stopper blocks 18 having rear projections 181 which keeps a space 182 between the front and rear support legs 11, 11' when folding the same so as to protect the hand of the user that holds the front support legs 11 from being clamped and injured (as shown in FIG. 5), and wherein the rear stopper blocks 18' are bent blocks and disposed between the fixing plates 162 of the rear support leg 11' and the angle-adjusting means 17, the rear stopper blocks 18' being such bent that when the front and rear support legs 11, 11' are pivoted toward each other, the rear stopper blocks 18' form an obstacle at a bending corner and prevent the hand of the user that holds the rear support leg 11' from slipping into the bending corner and getting hurt (as shown in FIGS. 3 and 4); and a plurality of skidproof sleeves 19 formed with facial projecting stripes 191 and fitted on the lower sides of the front and rear support legs 11, 11' for creating a skidproof effect on the chair frame body 10.

The chair pad 20 is formed by a large cushion 21 and a small cushion 22 connected therewith. A plurality of loop-hook fasteners 23 are disposed along the periphery of the chair pad 20 whereby the chair pad 20 can be detachably fastened over the chair frame body 10 by means of securing the fasteners 23 with the seat frame 12 and the back frame 13. The small cushion 22 is laid on the upper bent portion of the column members 131 of the back frame 13 to serve as a pillow.

Figure 6:
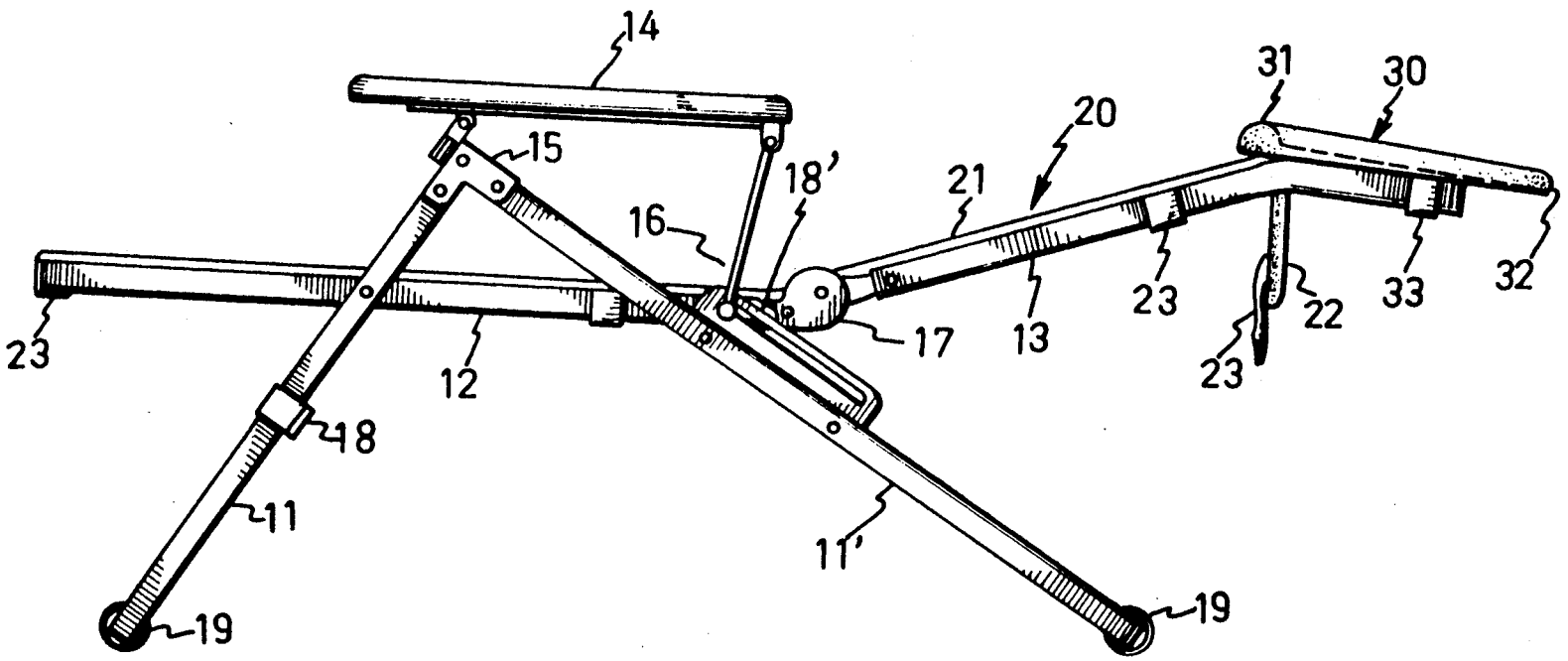
FIG. 6 is a plane side view, showing that the water-guiding pad is fastened on the upper portion of the back frame, making the leisure chair of the present invention alternatively serve as a shampooing chair.

The water-guiding pad 30 is formed with a central recess, a peripheral water-stopping wall 31 and a rear water-guiding opening 32. Two U-shaped clamping members 33 are disposed on a bottom surface of the water-guiding pad 30, whereby after the small cushion 22 is detached from the back frame 13, the clamping members 33 can be secured on the column members 131 of the back frame 13 to fix the water-guiding pad 30 on the back frame 13, forming a shampooing chair (as shown in FIG. 6).

Therefore, when the user desires to use the present invention as a leisure chair, the water-guiding pad 30 can be removed from the back frame 13 by means of upward sliding the clamping members 33 along the column members 131 of the back frame 13 and then the small cushion 22 can be disposed on the back frame 13 by means of the fasteners 23. Reversely, when the user wants to use the present invention as a shampooing chair, as previously described, the small cushion 22 can be detached from the column members 131 of the back frame 13 and replaced by the water-guiding pad 30. The angle-adjusting means 17 permits the user to freely adjust the angle contained by the back frame 13 and the seat frame 12 so as to form a comfortable shampooing chair.

According to the above arrangement, the present invention is inventive in both structure and function and can be safely and conveniently used. Moreover, the present invention can alternatively serve as a leisure chair or a shampooing chair as required. The above description and accompanying drawings are only used to show an example of the present invention and should not be considered a limitation of the present invention. Any derivation or modification of the example should be included in the scope of the present invention.

What is claimed is:

1. A safe multi-functional foldable leisure chair comprising a chair frame body, a chair pad disposed on said chair frame body, and a water-guiding pad optionally detachably disposed on said chair frame body, wherein said chair frame body is composed of:

a U-shaped front support leg and a U-shaped rear support leg, said front and rear support legs respectively having upper open sides and lower close sides, said upper open sides being connected with each other while said lower close sides being extended forward and rearward in a stretched state;

a horizontally disposed U-shaped seat frame having an open side which faces rearward, a plurality of first beam members being disposed between two arms of said seat frame, and a second beam member being disposed across said open side of said seat frame, two ends of said second beam member laterally projecting from said open side of said seat frame;

an H-shaped back frame having two lateral column members upper ends of which being slightly bent rearward and lower ends thereof being connected with said open side of said seat frame by angle-adjusting means so that the angle contained by said back frame and said seat frame can be freely adjusted;

two rail members disposed on said connected open sides of said front and rear support legs;

two pivot seats pivotally connected with front ends of said rail members and said open sides of said front and rear support legs, permitting said rail members and said front and rear support legs to be pivoted toward one another through a certain angle;

two fixing sets each of which has a T-shaped fixing rod and a fixing plate, wherein said fixing plate is secured on an inner middle section of said rear support leg and formed with an L-shaped slot having a downward facing hook portion, lower end of said T-shaped fixing rod extending downward to connect with the end of said second beam member which goes through said L-shaped slot , upper end of said fixing rod being pivotally connected under a rear end of said rail member, whereby when the end of said second beam member is engaged in said hook portion of said L-shaped slot, said chair frame body is prevented from being folded while when the end of said second beam member is slided within said L-shaped slot, said chair frame body can be folded into a small body; and two front stopper blocks and two rear stopper blocks, wherein said front stopper blocks are disposed on a middle section of said front support leg and said rear stopper blocks are disposed between said fixing means and said rear support legs, whereby when said front and rear support legs are pivoted toward each other, said front and rear stopper blocks prevent the hands of the user that hold said front and rear support legs from being clamped and injured; and wherein said chair pad is formed by a large cushion and a small cushion connected therewith, a plurality of loop-hook fasteners being disposed along a periphery of said chair pad, whereby the chair pad can be detachably fastened over said chair frame body by means of securing said fasteners with said seat frame and back frame; and wherein said water-guiding pad is provided with two U-shaped clamping members disposed on a bottom surface of said water-guiding pad, whereby after said small cushion is detached from said back frame , said clamping members can be secured on said column members of said back frame to fix said water-guiding pad on said back frame, forming a shampooing chair.

2. A leisure chair as claimed in claim 1, wherein said front stopper blocks are rectangular blocks, having rear projections which keep a space between said front and rear support legs when folding the same.

3. A leisure chair as claimed in claim 1, wherein said rear stopper blocks are angle blocks, forming an obstacle at a bending corner contained by said front and rear support legs, whereby when folding the same, said rear stopper blocks prevent the hand of a user from slipping into the bending corner and getting hurt.

4. A leisure chair as claimed in claim 1, wherein a plurality of skidproof sleeves having facial projecting stripes are fitted on said lower sides of said front and rear support legs for creating skidproof effect.

5. A leisure chair as claimed in claim 1, wherein a plurality of beam members are connected between said column members of said back frame.

* * * * *